US007500822B2

(12) United States Patent
Huntley et al.

(10) Patent No.: US 7,500,822 B2
(45) Date of Patent: Mar. 10, 2009

(54) COMBINED VACUUM PUMP LOAD-LOCK ASSEMBLY

(75) Inventors: Graeme Huntley, Nr Bridgwater (GB); Neil Geoffrey Bellenie, Pleasanton, CA (US)

(73) Assignee: Edwards Vacuum, Inc., Wilmington, MA (US)

( * ) Notice: Subject to any disclaimer, the term of this patent is extended or adjusted under 35 U.S.C. 154(b) by 557 days.

(21) Appl. No.: 10/822,189

(22) Filed: Apr. 9, 2004

(65) Prior Publication Data

US 2005/0226739 A1 Oct. 13, 2005

(51) Int. Cl.
*F04D 29/60* (2006.01)
*F04D 23/00* (2006.01)

(52) U.S. Cl. ..... 415/90; 118/715

(58) Field of Classification Search ..... 415/90, 415/220, 221; 118/719; 156/345.29, 345.31, 156/345.32, 345.33

See application file for complete search history.

(56) References Cited

U.S. PATENT DOCUMENTS

| | | | | |
|---|---|---|---|---|
| 4,534,314 | A | 8/1985 | Ackley | |
| 5,000,225 | A | 3/1991 | Murdoch | |
| 5,031,674 | A | 7/1991 | Mack | |
| 5,730,801 | A | 3/1998 | Tepman et al. | |
| 5,785,796 | A * | 7/1998 | Lee | 156/345.24 |
| 5,820,723 | A | 10/1998 | Benjamin et al. | |
| 5,848,873 | A | 12/1998 | Schofield | |
| 5,883,017 | A | 3/1999 | Tepman et al. | |
| 6,109,864 | A | 8/2000 | Schofield et al. | |
| 6,135,709 | A | 10/2000 | Stones | |
| 6,161,576 | A | 12/2000 | Maher et al. | |
| 6,176,667 | B1 | 1/2001 | Fairbairn et al. | |
| 6,323,463 | B1 | 11/2001 | Davis et al. | |
| 6,375,413 | B1 | 4/2002 | Stones | |
| 6,454,508 | B2 * | 9/2002 | Toshima et al. | 414/217 |
| 6,486,444 | B1 | 11/2002 | Fairbairn et al. | |
| 6,609,877 | B1 | 8/2003 | Ramsay | |
| 6,626,639 | B2 | 9/2003 | Schofield | |
| 7,077,159 | B1 * | 7/2006 | Reimer et al. | 137/565.23 |
| 7,276,122 | B2 * | 10/2007 | Devine et al. | 118/719 |

FOREIGN PATENT DOCUMENTS

| | | |
|---|---|---|
| EP | 1 014 427 A2 | 6/2000 |

* cited by examiner

*Primary Examiner*—Edward Look
*Assistant Examiner*—Nathaniel Wiehe
(74) *Attorney, Agent, or Firm*—Ira Lee Zebrak

(57) ABSTRACT

A load-lock and dry vacuum pump assembly includes a load-lock having a load-lock housing, the load-lock housing includes a mating system having a flange-like cylinder and a cylinder concentrically located relative to said flange-like cylinder; a dry vacuum pump that includes a shaft, a rotor, a first concentric cylinder and a second concentric cylinder extending outwardly from the rotor, and is integrally connected with the mating system, the first and second dry vacuum pump concentric cylinders, the flange-like cylinder, and the cylinder concentrically located relative to said flange being axially arranged with respect to the shaft; and a molecular drag compression stage formed by flanges having helical structures selectively provided on the first and second concentric cylinders, the flange-like cylinder, and the cylinder concentrically located relative to the flange. The first and second concentric cylinders spin relative to the flange-like cylinder and the cylinder concentrically located relative to the flange.

19 Claims, 2 Drawing Sheets

COMBINED VACUUM PUMP LOAD-LOCK ASSEMBLY

TECHNICAL FIELD

The present invention relates to an improved load-lock and vacuum pump assembly for use in semiconductor processing.

BACKGROUND

When processing semiconductor wafers, it is necessary to deposit materials onto and remove materials from the semiconductor wafers. The transfer of material onto and from the semiconductor wafers is used to enhance the electrical properties of the semiconductor wafers. In order to transfer materials onto and from the semiconductor wafers, various gases are used to impinge the semiconductor wafers. For example, to remove contaminants from the semiconductor wafers, a processing gas can be used to contact the semiconductor wafers, and react with the contaminants thereon. However, before such processing can occur, the semiconductor wafers must be provided in a low pressure environment. Therefore, vacuum processing systems are used to remove the semiconductor wafers to a low-pressure environment.

These vacuum processing systems employ a load-lock chamber and vacuum pumps. For example, the semiconductor wafers are placed in the load-lock chamber, and the load-lock chamber is subsequently evacuated using the vacuum pumps. After evacuation, the semiconductor wafers are provided in a low pressure environment, and can thereafter be subjected to further processing.

A dry vacuum pump can be used to evacuate the load-lock chamber to a low pressure. Generally, the cost of pumping the interior of the load-lock chamber to a low pressure is related to five parameters: (1) the amount of gas to be evacuated; (2) the interior surface area of the load-lock chamber; (3) the low pressure required in the load-lock chamber; (4) the resistance in the piping between the load-lock chamber, and the dry vacuum pump; and (5) the time required for providing the low pressure in the load-lock chamber.

Another cost is related to the number of semiconductor wafers each load-lock chamber is capable of processing at one time. Therefore, to reduce the cost of pumping the interior of the load-lock chamber to a low pressure, some have increased the number of semiconductor wafers processed at a time. However, to accommodate the increased number of semiconductor wafers, the size of the load-lock chamber must also be increased. Therefore, such "batch" processing significantly increases the amount of gas to be evacuated and the interior surface area of the load-lock chamber.

Consequently, there is a need to reduce the cost of pumping the interior of the load-lock chamber to a low pressure without the need to resort to "batch" processing. By reducing or eliminating the resistance in the piping between the load-lock chamber and the dry vacuum pump, it is possible to reduce the costs of pumping without the need for resorting to "batch" processing.

SUMMARY

A load-lock and dry vacuum pump assembly, comprising a load-lock having a housing, at least one load-lock chamber provided in the load-lock housing, at least one loading port and at least one unloading port provided to at least one load-lock chamber, and a mating system, wherein the mating system includes a flange-like cylinder; and a dry vacuum pump having a shaft, a rotor securely attached to the shaft, and a body portion through which the shaft extends, wherein the body portion in attached to the flange-like cylinder.

A load-lock and dry vacuum pump assembly is further provided, comprising a load-lock having a load-lock housing, the load-lock housing including a mating system, wherein the mating system includes a flange-like cylinder, and a cylinder concentrically located relative to the flange-like cylinder; a dry vacuum pump integrally connected with the mating system, the dry vacuum pump including a shaft, a rotor, a first concentric cylinder and a second concentric cylinder extending outwardly from the rotor, wherein the first and the second concentric cylinders, the flange-like cylinder, and the cylinder concentrically located relative to the flange are axially arranged with respect to the shaft; and flanges having helical structures selectively provided on the first and the second concentric cylinders, the flange-like cylinder, and the cylinder concentrically located relative the flange, and wherein the first and the second concentric cylinders spin relative to the flange-like cylinder and the cylinder concentrically located relative the flange to form a molecular drag compression stage.

DETAILED DESCRIPTION

Figure 1:
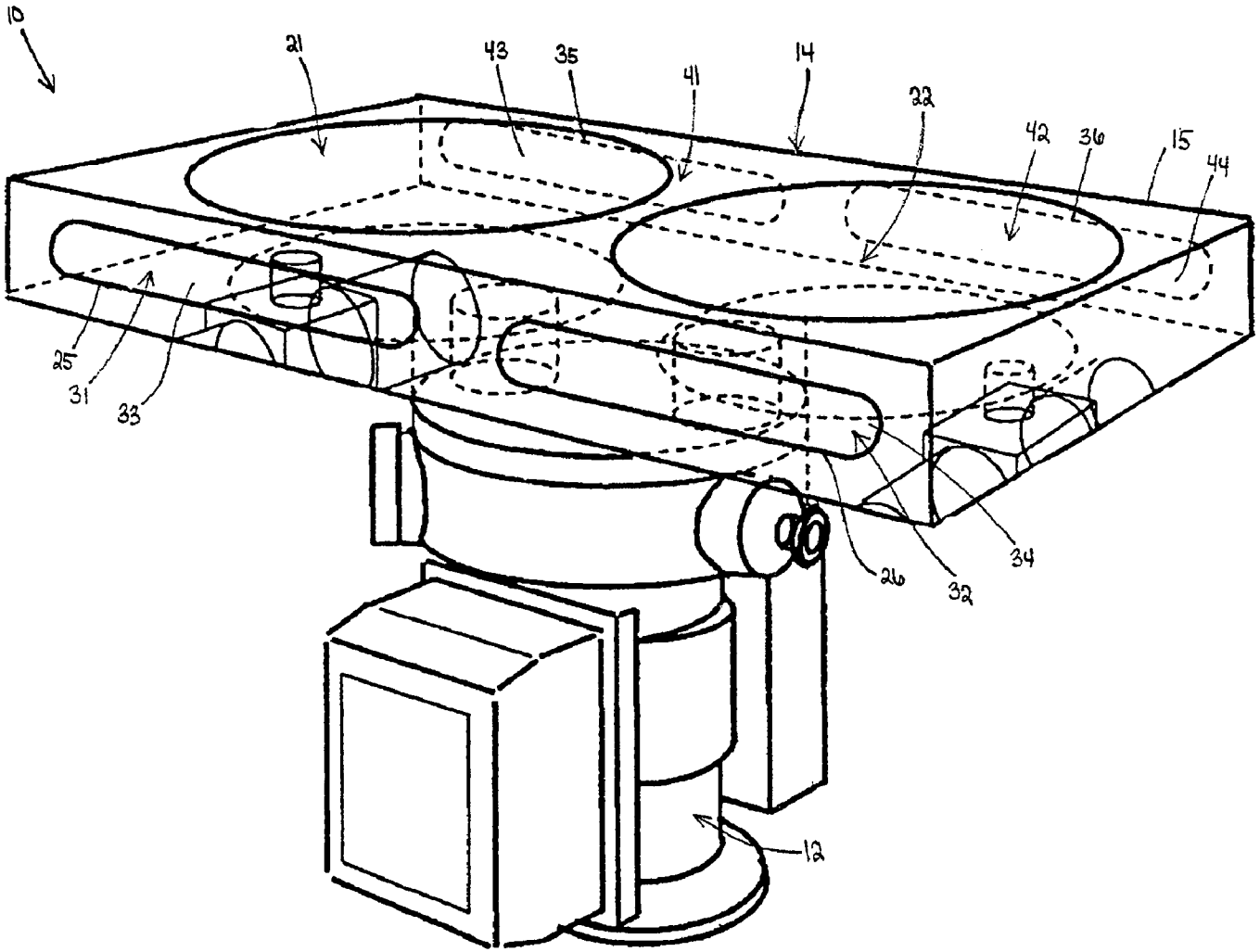
FIG. 1 is a perspective view of the combined assembly of the dry vacuum pump and load-lock chamber.
Figure 2:
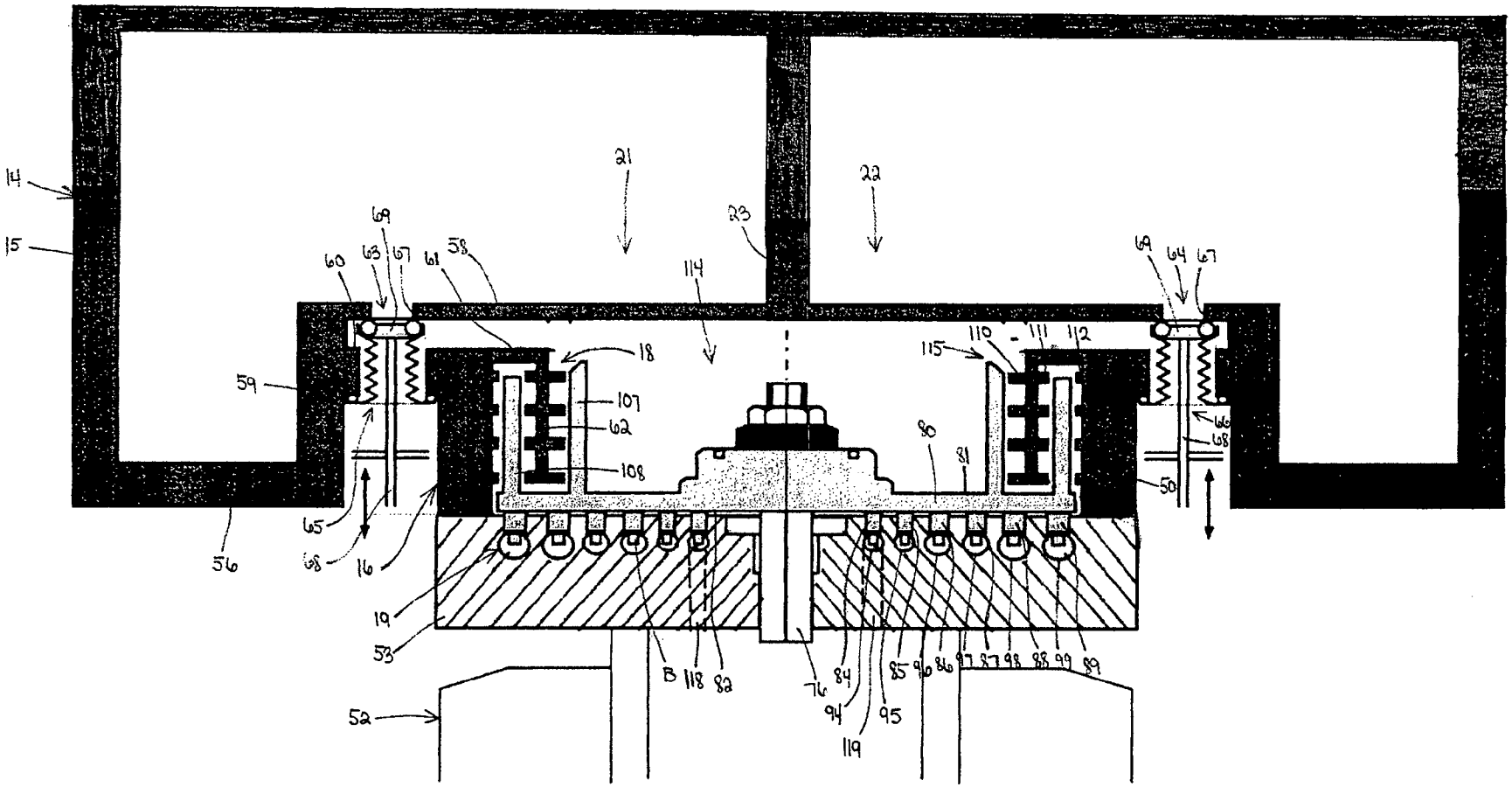
FIG. 2 is a cross-sectional view of the integral connection of the dry vacuum pump and load-lock chamber.

Referring to FIGS. 1 and 2, a combined vacuum pump and load-lock assembly, is generally indicated by the numeral 10. The assembly 10 is formed from a dry vacuum pump 12 and a lock-lock 14 integrally connected. The load-lock 14 includes a load-lock housing 15 with a mating system 16 adapted to integrally accept the dry vacuum pump 12. The connection between the dry vacuum pump 12 and load-lock 14 eliminates the resistance associated with the transitional piping normally extending therebetween. To that end, a molecular drag (such as a Holweck) stage 18 is formed by components of the mating system 16 shared with the dry vacuum pump 12. The molecular drag stage 18 together with a regenerative stage 19 formed in the dry vacuum pump 12 allow the assembly 10 to generate a vacuum in the load-lock 14.

The load-lock housing 15 can include first load-lock chamber 21 and a second load-lock chamber 22. The first and second load-lock chambers 21 and 22 provide an area where the above-discussed vacuum is generated. The first and second load-lock chambers 21 and 22 are vacuum-tight, and can be cycled between a high pressure and a low pressure. Normally, the high pressure will be approximately atmospheric pressure, and the low pressure will be approximately a vacuum. Therefore, semiconductor wafers (not shown) can enter the first and second load-lock chambers 21 and 22 at the high pressure and exit at the chambers at the low pressure.

To form the first and second load-lock chambers 21 and 22, the load-lock housing 15 is divided into two portions. For example, as seen in FIG. 2, a wall 23 separates the first load-lock chamber 21 and second load-lock chamber 22. Furthermore, as discussed below, the first and second load-lock chambers 21 and 22 are separately connected to the dry vacuum pump 12, and can be separately evacuated.

During operation, semiconductor wafers are deposited onto and removed from wafer seats (not shown) provided in the first and the second load-lock chambers 21 and 22. The semiconductor wafers are inserted into the first and second load-lock chambers 21 and 22 through a first loading port 25 and a second loading port 26, respectively. The first and second loading ports 25 and 26 are respectively equipped with slit valves 31 and 32. The slit valves 31 and 32 respectively include doors 33 and 34 that can be opened and closed by actuators (not shown) with respect to the first and second loading ports 25 and 26. In fact, the actuators can exert forces to sealingly engage the doors 33 and 34, and first and second loading ports 25 and 26.

Such sealing engagement can be enhanced to provide vacuum-tight seals between the doors 33 and 34, and the first and second loading ports 25 and 26. For example, the doors 33 and 34 can be provided with seating surfaces (not shown), and the first and second loading ports 25 and 26 can be provided sealing surfaces such as O-rings (not shown). When the slit valves 31 and 32 are closed, these seating surfaces and sealing surfaces can prevent atmospheric air from entering the first and second load-lock chambers 21 and 22.

The load-lock housing 15 can also be provided with a first unloading port 35 and a second unloading port 36. Like the first and second loading ports 25 and 26, the first and second unloading ports 35 and 36 are provided with slit valves 41 and 42 with doors 43 and 44. In the manner described hereinabove, the doors 43 and 44 are adapted to sealingly engage with the first and second unloading ports 35 and 36. Like the slit valves 31 and 32, when the slit valves 41 and 42 are closed, atmospheric air is prevented from entering the first and second load-lock chambers 21 and 22.

When the slit valves 31, 32 and 41, 42 are closed, the vacuum-tight seals formed thereby isolate the first and second load-lock chambers 21 and 22 from atmospheric air, and allow the air remaining in the processing chambers to be evacuated using the dry vacuum pump 12. That is, the closing of slit valves 31, 32 and 41, 42 allows the first and second load-lock chambers 21 and 22 to be pumped to the above-discussed low pressure.

To "process" the semiconductor wafers, the first and second loading ports 25 and 26 can be initially opened, and the semiconductor wafers can be positioned in the first and second load-lock chambers 21 and 22 using a robot arm (not shown). The slit valves 31 and 31 are thereafter closed, and the slit valves 31, 32 and 41, 42 remain closed during pumping. After the first and second load-lock chambers 21 and 22 are pumped to a low pressure, the slit valves 41 and 42 are opened, and the semiconductor wafers can be removed from the first and second load-lock chambers 21 and 22 by another robot arm (not shown).

As discussed hereinabove, the dry vacuum pump 12 is integrally connected to the housing of the load-lock housing 15 by the mating system 16. That is, the load-lock housing 15 is adapted to integrally receive the dry vacuum pump 12 without the need for transitional piping. For example, the mating system 16 may include a flange-like cylinder 50 configured to receive a portion of the dry vacuum pump 12. More specifically, the dry vacuum pump 12 includes a pump housing 52 with a body portion 53 that can be attached directly to the flange-like cylinder 50.

In addition, as discussed above, the mating system 16 includes components that are shared with the dry vacuum pump 12 to form the molecular drag stage 18. Furthermore, the mating system 16 provides valve passages for fluid communication between the first and second load-lock chambers 21 and 22, and the dry vacuum pump 12.

The mating system 16 is partially formed out of the bottom wall 56 of the load-lock housing 15. For example, the bottom wall 56 includes an offset wall portion 58 and a cylindrical wall portion 59. The cylindrical wall portion 59 joins the offset wall portion 58 with the remainder of the bottom 56. As also part of the mating system 16, the offset wall portion 58 and cylindrical wall portion 59 effectively "carve out" portions of the first and second load-lock chambers 21 and 22. Extending radially inwardly of the cylindrical wall portion 59 is a support plate 60, and an attachment plate 61. The flange-like cylinder 50 is supported relative to the load-lock housing 15 by the support plate 60. Furthermore, the attachment plate 61 positions a concentric cylinder 62 adjacent to the flange-like cylinder 50. The concentric cylinder 62 shares its axis with the flange-like cylinder 50, and, as discussed below, the flange-like cylinder 50 and concentric cylinder 62 are shared with the dry vacuum pump 12.

A first passage 63 and a second passage 64 are provided through the offset wall portion 58. The first and second passages 63 and 64 provide fluid communication between the first and second load-lock chambers 21 and 22 and the dry vacuum pump 12, and a first valve assembly 65 and a second valve assembly 66 are, respectively, disposed within the first and second passages 63 and 64. The first valve assembly 65 and the second valve assembly 66 can selectively provide communication between the dry vacuum pump 12 and the first and second load-lock chambers 21 and 22. The first and second passages 63 and 64 each include a valve seat 67, and the first and second valve assemblies 65 and 66 each include a valve stem 68 provided through the support plate 60, and attached to an actuator (not shown). The valve stem 68 supports a valve plug 69 configured to interface with the valve seat 67. The actuator reciprocally engages and disengages the valve plug 69 with the valve seat 67. Therefore, when either the first and second valve assemblies 65 and 66 are open, the first and second load-lock chambers 21 and 22 respectively can be evacuated. In fact, cooperation between the mating system 16 and the dry vacuum pump 12 serves to evacuate the first and second load-lock chambers 21 and 22.

As discussed above, the dry vacuum pump 12 includes pump housing 52. Mounted within the pump housing 52, is a shaft 76. The shaft 76 is adapted for rotation about its longitudinal axis, and is driven by an electrical motor (not shown).

Furthermore, as discussed above, the regenerative stage 19 is formed within the dry vacuum pump 12. For example, a rotor 80 is securely attached to the shaft 76. The rotor 80 is disk-shaped, and includes an upper surface 81 and a lower surface 82. The regenerative stage 19 is formed between the lower surface 82 of the rotor 80 and the body portion 53 of the pump housing 52.

In one embodiment, the lower surface 82 includes six raised rings 84, 85, 86, 87, 88, 89 symmetrically situated about the shaft 76. A series of equally spaced blades B are mounted on each of the raised rings 84, 85, 86, 87, 88, 89. Each of the blades B is slightly arcuate with the concave side pointing in the direction of travel of the rotor 80. Furthermore, one hundred blades B are provided on each of the raised rings 84, 85, 86, 87, 88, 89 to form six concentric annular arrays. The width of each of the raised rings 84, 85, 86, 87, 88, 89, and the corresponding size of the blades B on each ring, gradually decreases from the outermost raised ring 89 to the inner most raised ring 84.

The body portion 53 forms the stator of the regenerative stage 19, and contains six concentric circular channels 94, 95, 96, 97, 98, 99. The channels 94, 95, 96, 97, 98, 99 are formed within the body portion 53, and each keyhole-shaped with an upper portion 102 and a lower portion 103. The upper portions 102 of channels 94, 95, 96, 97, 98, 99 are respectively sized to accommodate the raised rings 84, 85, 86, 87, 88, 89, and the lower portions 103 are sized to accommodate the corresponding blades B of the relevant raised ring.

In one embodiment, the cross-sectional area of the blades B as seen in FIG. 2, is about ⅙ of the largest cross-sectional area of the corresponding channels 94, 95, 96, 97, 98, 99. However, each of the channels 94, 95, 96, 97, 98, 99 also has a reduced cross-sectional area along part of its length. This reduced cross-sectional area has substantially the same size as the corresponding blades B accommodated therein. This reduced cross-sectional area forms the "stripper" which urges gas passing through a channel to be deflected by porting (not shown) into the adjacent inner channel.

As discussed above, the molecular drag stage 18 is formed by components shared by the mating system 16 with the dry vacuum pump 12. More specifically, the flange-like cylinder 50 and concentric cylinder 62 are shared with the dry vacuum pump 12. The flange-like cylinder 50 and concentric cylinder 62 are oriented axially with respect to the shaft 76, and form the stator of the molecular drag stage 18.

The flange-like cylinder 50 and concentric cylinder 62 interrelate with a first concentric cylinder 107 and second concentric cylinder 108 extending outwardly from the rotor 80. Like the flange-like cylinder 50 and concentric cylinder 62, the first and second concentric cylinders 107 and 108 are oriented axially with respect to the shaft 76. The flange-like cylinder 50, concentric cylinder 62, and first and second concentric cylinders 107 and 108 are mounted symmetrically about the axis of the shaft 76. Furthermore, first and second concentric cylinders 107 and 108 are inter-leaved with the flange-like cylinder 50 and concentric cylinder 62, thereby forming uniform gaps between adjacent cylinders. Consequently, a uniform gap is formed between the first concentric cylinder 107 and concentric cylinder 62, another uniform gap is formed between the second concentric cylinder 108 and concentric cylinder 62, and another uniform gap is formed between the second concentric cylinder 108 and the flange-like cylinder 50. These uniform gaps are gradually reduced in dimensions from the innermost cylinder (the first concentric cylinder 106) to the outermost cylinder (flange-like cylinder 50).

Situated in the gaps between adjacent cylinders are various threaded upstanding flanges. These various flanges have helical structures substantially extending across their respective gaps. These flanges can be attached to either of the adjacent cylinders. However, in certain embodiments, and as seen in FIG. 2, a first flange 110 is attached to the inner facing surface of the concentric cylinder 62, a second flange 111 is attached to the outer facing surface of the concentric cylinder 62, and a third flange 112 is attached to the inner facing surface of the flange-like cylinder 50. Although not shown in the drawings, the rotor 80 and the first and second concentric cylinders 107 and 108 could usefully be manufactured as a one-piece component made, for example, from aluminum or an aluminum alloy.

During operation of the assembly 10, gas present in the first and second load-lock chambers 21 and 22 is drawn through the first and second passages 63 and 64 into a space 114 defined between the mating system 16 and the dry vacuum pump 12 by the rotor 80 spinning at high speeds. Thereafter, the gas is drawn into the molecular drag stage 18. The gas enters an inlet 115 between the first concentric cylinder 107 and concentric cylinder 62. The gas then passes down the first flange 110, thence up the second flange 111, and thence down the third flange 112. It then passes through porting (not shown) connecting the molecular drag stage 18 to the regenerative stage 19. In the regenerative stage 19, the gas enters channel 99, thence through channels 98, 97, 96, 95, 94 (in that order) by the action of the respective strippers until being exhausted from the pump via the bores 118 and 119 in the body portion 53. Therefore, the flow of gas is generally radially outwards in the molecular drag stage 18 and radially inwards in the regenerative stage 19, thereby leading to a balanced, efficient assembly 10.

Ideally, the electrical motor operates continuously during operation of the assembly 10. Such continuous operation advantageously increases the life of the electrical motor. To allow the electrical motor to operate in such a manner, rather than cycling up and down to correspond with the simultaneous evacuation of the both first and second load-lock chambers 21 and 22, the chambers can be separately evacuated.

To illustrate, the first load-lock chamber 21 can be evacuated while the second load-lock chamber 22 is being unloaded and loaded, or the second load-lock chamber 22 can be evacuated while the first load-lock chamber 21 is being unloaded or loaded.

For example, when the first load-lock chamber 21 is being evacuated, the first valve assembly 65 is open, and gas from the first load-lock chamber 21 is being drawn through the first passage 63 into the molecular drag stage 18 and regenerative stage 19 to exit through the bores 118 and 119. At the same time, the second valve assembly 66 is closed (prohibiting communication with the dry vacuum pump 12), thereby allowing the slit valve 42 to be opened to remove the semiconductor wafers at the low pressure through the second unloading port 36. Thereafter, the slit valve 42 is closed, and the slit valve 32 is opened to insert semiconductor wafers at the high pressure into the second load-lock chamber 22 through the second loading port 26. After loading is complete, the second load-lock chamber 22 is prepared for evacuation.

Furthermore, when the second load-lock chamber 22 is being evacuated, the second valve assembly 66 is open, and gas from the second load-lock chamber 22 is being drawn through the second passage 64 into the molecular drag stage 18 and regenerative stage 19 to exit through the bores 118 and 119. At the same time, the first valve assembly 65 is closed (prohibiting communication with the dry vacuum pump 12), thereby allowing the slit valve 41 to be opened to remove the semiconductor wafer at the low pressure through the first unloading port 35. Thereafter, the slit valve 41 is closed, and the slit valve 31 is opened to insert the semiconductor wafers at the high pressure into the first load-lock chamber 21 through the first loading port 25. After loading is loading, the first load-lock chamber 22 is prepared for evacuation, and the above-discussed cycle is repeated.

As can be appreciated, the proximity of the load-lock 14 to the dry vacuum pump 12 afforded by the use of the mating system 16 eliminates any resistance therebetween. As such, using the mating system 16 allows the time required for providing the low pressure in the first and second load-lock chambers 21 and 22 to be decreased. Such time savings avoids the necessity of resorting to "batch" processing of the semiconductor wafers, while simultaneously reducing the cost of processing.

It will be understood that embodiments described herein are merely exemplary, and that one skilled in the art may make variations and modifications without departing from the spirit and scope of the invention. All such variations and modifications are intended to be included within the scope of the invention as described hereinabove. It should be understood that any embodiments described hereinabove are only in the alternative, but can be combined.

We claim:

1. A load-lock and dry vacuum pump assembly, comprising:

a load-lock having a load-lock housing including a first load-lock chamber and a second load-lock chamber, said load-lock housing including a mating system, wherein said mating system includes a support plate extending radially inwardly of the load-lock housing, a flange-like cylinder supported relative to the load-lock housing by the support plate, and a cylinder concentrically located relative to said flange-like cylinder, a dry vacuum pump integrally connected with said mating system, said dry vacuum pump including a shaft, a rotor, a first concentric cylinder and a second concentric cylinder extending outwardly from said rotor, wherein said first and said second concentric cylinders, said flange-like cylinder, and said cylinder concentrically located relative to said flange are axially arranged with respect to said shaft, flanges having helical structures selectively provided on said first and said second concentric cylinders, said flange-like cylinder, and said cylinder concentrically located relative said flange, and wherein said first and said second concentric cylinders spin relative to said flange-like cylinder and said cylinder concentrically located relative said flange to form a molecular drag compression stage; and a first valve selectively providing communication between the dry vacuum pump and the first chamber and a second valve selectively providing communication between the dry vacuum pump and the second chamber, the first and second valves including valves stems extending through the support plate.

2. An assembly according to claim 1, wherein said dry vacuum pump includes a pump housing having a body portion, said body portion including a plurality of concentric circular channels, and wherein said rotor includes an upper surface and a lower surface, and a plurality of raised rings provided on said lower surface, said plurality of raised rings symmetrically situated about said shaft, and said plurality of concentric circular channels accommodating said plurality of raised rings to form a regenerative compression stage.

3. An assembly according to claim 2, wherein said molecular drag compression stage is connected to said regenerative compression stage, and together said molecular drag compression stage and said regenerative compression stage are adapted to remove gas disposed within said load-lock.

4. An assembly according to claim 3, wherein said flanges are provided on the inner facing surface of said flange-like cylinder, and the inner and outer facing surfaces of said cylinder concentrically located relative to said flange-like cylinder.

5. A load-lock and dry vacuum pump assembly, comprising:

a load-lock having a housing, first and second load-lock chambers provided in said load-lock housing, at least one loading port and at least one unloading port provided to said load-lock chambers, and a mating system, wherein said mating system includes a support plate extending radially inwardly of the load-lock housing, and a flange-like cylinder supported relative to the load-lock housing by the support plate;

a dry vacuum pump having a shaft, a rotor securely attached to said shaft, and a body portion though which said shaft extends, wherein said body portion is attached to said flange-like cylinder; and a first valve selectively providing communication between the dry vacuum pump and the first chamber and a second valve selectively providing communication between the dry vacuum pump and the second chamber, the first and second valves including valves stems extending through the support plate.

6. An assembly according to claim 5, wherein said dry vacuum pump separately evacuates said first load-lock chamber and said second load-lock chamber.

7. An assembly according to claim 6, wherein said first load-lock chamber includes a first loading port and a first unloading port, and said second load-lock chamber includes a second loading port and a second unloading port.

8. An assembly according to claim 7, wherein said first and second loading ports and said first and second unloading ports include slit valves adapted to prevent atmospheric air from respectively entering said first load-lock chamber and said second load-lock chamber.

9. An assembly according to claim 5, further comprising a first concentric cylinder and a second concentric cylinder extending outwardly from said rotor, wherein said flange-like cylinder surrounds said first concentric cylinder and said second concentric cylinder, and a concentric cylinder attached to said flange-like cylinder is positioned between said first concentric cylinder and said second concentric cylinder.

10. An assembly according to claim 9, further comprising substantially uniform gaps formed between said first concentric and said concentric cylinder, between said second concentric cylinder and said concentric cylinder, and between said second concentric cylinder and said flange-like cylinder, wherein flanges having helical structures are provided within said substantially uniform gaps.

11. An assembly according to claim 10, wherein a first of said flanges is attached to the inner facing surface of said concentric cylinder, a second of said flanges is attached to the outer facing surface of said concentric cylinder, and a third of said flanges is attached to the inner facing surface of said flange-like cylinder.

12. An assembly according to claim 5, further comprising a molecular drag compression stage comprising said flange-like cylinder and a concentric cylinder attached to said flange-like cylinder interleaved with a first concentric cylinder and a second concentric cylinder, and flanges selectively disposed on said first concentric cylinder, said second concentric cylinder, said flange-like cylinder, and said concentric cylinder attached to said flange-like cylinder, wherein said first concentric cylinder and said second concentric cylinder extend outwardly from said rotor, said first concentric cylinder and said second concentric cylinder adapted to spin relative to said flange-like cylinder and said concentric cylinder attached to said flange-like cylinder.

13. An assembly according to claim 12, further comprising a regenerative compression stage formed between said rotor and said body portion, wherein concentric circular channels are formed within said body portion, and wherein said rotor has an upper surface and a lower surface, wherein various raised rings are disposed on said lower surface, and a series of spaced blades are mounted on each of said various raised rings, said various raised rings and said series of spaced blades mounted on each of said various raised rings fitting within said concentric circular channels.

14. An assembly according to claim 5, further comprising a regenerative compression stage formed between said rotor and said body portion, wherein concentric circular channels are formed within said body portion, and wherein said rotor has an upper surface and a lower surface, wherein various raised rings are disposed on said lower surface, and a series of spaced blades are mounted on each of said various raised rings, said various raised rings and said series of spaced blades mounted on each of said various raised rings fitting within said concentric circular channels.

15. An assembly according to claim 5, wherein said body portion of said dry vacuum pump is attached directly to said flange-like cylinder to integrally connect said load-lock with said dry vacuum pump.

16. An assembly according to claim 5, wherein said load-lock housing includes a bottom wall, and at least one passage is provided through said bottom wall to allow for fluid communication between said at least one load-lock chamber and said dry vacuum pump.

17. An assembly according to claim 16, wherein said load-lock housing includes a first passage through said bottom wall which provides communication between said dry vacuum pump and said first load-lock chamber and a second passage through said bottom wall which provides communication between said dry vacuum pump and said second load-lock chamber.

18. An assembly according to claim 17, wherein said valves are disposed within each of said first passage and said second passage.

19. An assembly according to claim 5, further comprising a regenerative compression stage formed within said dry vacuum pump, and a molecular drag compression stage formed by components shared by said load-lock and said dry vacuum pump.

* * * * *